United States Patent [19]

Leal

[11] Patent Number: 4,514,723

[45] Date of Patent: Apr. 30, 1985

[54] METHOD AND APPARATUS FOR DEPICTING INOPERATIVE ELECTRICAL FUSES

[76] Inventor: David T. Leal, P.O. Box 14227, South Lake Tahoe, Calif. 95702

[21] Appl. No.: 484,915

[22] Filed: Apr. 14, 1983

[51] Int. Cl.[3] ..... G08B 21/00

[52] U.S. Cl. ..... 340/638; 337/241; 340/639; 361/349; 361/430

[58] Field of Search ..... 340/638, 639, 644; 337/241, 242, 206, 265, 266, 332, 376; D13/35; 361/349, 360, 430, 431

[56] References Cited

U.S. PATENT DOCUMENTS

| | | | |
|---|---|---|---|
| 852,539 | 5/1907 | Buchanan | 337/242 |
| 1,850,813 | 3/1932 | Smalley | 337/242 |
| 2,623,099 | 12/1952 | Wallace et al. | 340/639 X |
| 4,056,816 | 11/1977 | Guim | 340/638 |
| 4,157,486 | 6/1979 | Fegley | 340/638 |

FOREIGN PATENT DOCUMENTS

| | | | |
|---|---|---|---|
| 2060884 | 6/1972 | Fed. Rep. of Germany | 324/133 |
| 2831139 | 1/1980 | Fed. Rep. of Germany | 340/638 |
| 657621 | 5/1929 | France | 340/638 |
| 98903 | 4/1979 | Japan | 340/638 |
| 1549932 | 8/1979 | United Kingdom | 337/242 |

OTHER PUBLICATIONS

Source publication: Practical Electronics, vol. 12, No. 3, p. 239, Mar. 1976, "Fuse Monitor For Cars", by A. Foster.

*Primary Examiner*—James L. Rowland
*Assistant Examiner*—Daniel Myer
*Attorney, Agent, or Firm*—Herbert C. Schulze

[57] ABSTRACT

This is a method, and apparatus for practicing the method, by which electrical fuses or circuit breakers which have become inoperative by failure or overload can be instantly identified. The method and apparatus involves the use of light emitting diodes or the like connected in parallel with fuses in such a manner that when a fuse or circuit breaker fails in carrying an electrical load the flow of electrical current will be diverted to the light emitting device and cause it to visually signal the failure.

1 Claim, 8 Drawing Figures

METHOD AND APPARATUS FOR DEPICTING INOPERATIVE ELECTRICAL FUSES

CROSS REFERENCE TO RELATED PATENT APPLICATIONS

There are no patent applications filed by me related to this application.

BACKGROUND OF THE INVENTION

1. Field of the Invention

This invention is in the general field of electrical fuses and circuit breakers and is more particularly directed to a method and apparatus for visually signaling and identifying a fuse or circuit breaker which has failed or has become inoperative because of overload or other electrical fault. The invention is even more particularly directed to a method and apparatus for depicting such fuses or circuit breakers which have lost their ability to carry electrical current by utilizing a light emitting diode or the like in parallel with a fuse in such a manner that when the fuse can no longer carry electrical current the light emitting device will emit light from diverted electrical current.

2. Description of the Prior Art

There is no prior art related to this invention. At present fuses which have become incapable of carrying electrical current are detected through a visual inspection or by applying an ohm meter or the like to determine whether such fuses are intact and capable of functioning. There has been no prior art wherein a visual indicator separate from the fuse itself, or enclosed within the fuse case, is activated to disclose an inactive fuse.

SUMMARY OF INVENTION

Electrical fuses and circuit breakers (hereinafter frequently the word "fuse" or "circuit breaker" may be used alone, but, except wherein it recites something that is peculiar to a fuse or a circuit breaker, where either term is used it is understood to include the other) are widely used in connection with electrical circuits to provide protection against overloading of the system, shorting of an electrical element, and the like.

The customary fuse is of a material which will burn out immediately upon receiving an amount of electrical current in excess of that which is appropriate for the element being operated under normal conditions.

Frequently fuses are located in a bank of several fuses adjacent to one another, each controlling a different circuit such as in automotive fuses and the like. These banks of fuses are frequently in dark places and many fuses utilize thin wires or the like which cannot be immediately identified as having failed. Also, many fuses will fail in such manner that visual inspection of the fuse in place cannot reveal the failure.

Thus, it is frequently very difficult to determine by ordinary visual inspection if any particular fuse has failed, and, thus, in the case of failure of a circuit in an automobile or the like it cannot be readily ascertained which fuse failed.

The inability to be able to readily detect such failures makes correction difficult and frequently makes it impossible properly to operate vehicles or other pieces of equipment for lengthy periods of time when a simple identification of the particular circuit would solve the problem.

I have investigated this problem and a number of different means by which the failure of a fuse can be readily detected. One such means is the use of an ohm meter for purposes of testing individually each fuse. This, however, is complex in some respects and would require each automobile to carry such a meter or the like and even then it is difficult, in obscure light, to read the meter.

I have now conceived and developed a preferred method, and apparatus for practicing said method, wherein fuse failures will be automatically indicated by a self-contained, or exterior mounted, light emitting diode (or another visual indicator) so disposed in conjunction with the fuse that it will emit light when the fuse itself can no longer carry current. It accomplishes this by receiving the current flow which would otherwise be carried by the fuse causing the light emitting diode or proper circuit or device to emit light, or by sensing the failure by cessation of current flow or lack of continuity of the fuse. It is only when the fuse fails that the diode or other light emitting device will emit light.

It is an object of this invention to provide a method and apparatus by which a light indicates when a fuse which has failed by reason of overload or otherwise.

Another object of this invention is to provide such a means for identifying fuses which have failed wherein the light emitting device may be mounted exterior of said fuse.

Another object of this invention is to provide a bank of light emitting devices in conjunction with a bank of the fuses wherein when one fuse has failed the light emitting device for that particular fuse will be lighted while sound fuses will not be so indicated.

The foregoing and other objects and advantages of this invention will become apparent to those skilled in the art upon reading the following description of a preferred embodiment in conjunction with a review of the appended drawings.

DESCRIPTION OF A PREFERRED EMBODIMENT

Figure 1:
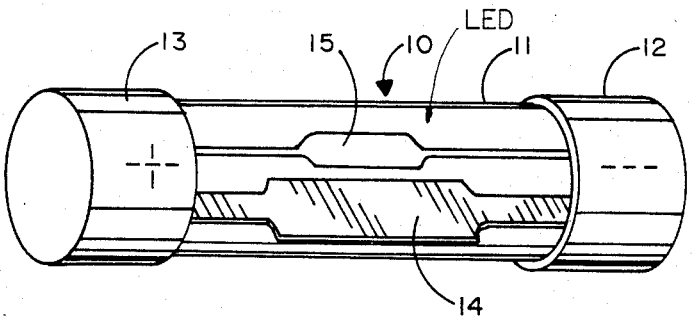
FIG. 1 is a perspective illustrating a fuse in place with a diode suitable to practice the method of this invention in place within the casing of the fuse.

FIG. 1 illustrates a customary fuse such as an automotive type fuse or the like having a glass or other visible cylinder 11 with two electrical current conducting caps 12 and 13 and a fuse element 14 fastened to the two caps 12 and 13. In this particular case the fuse also carries a diode 15 connected to the two caps 12 and 13. There is an indication in phantom on the fuse of polarity positive and negative for the purpose of explaining that the diode, of course, is polarized and must be connected to the right polar connections if it is to work correctly. This will be understood by those skilled in the art.

Figure 2:
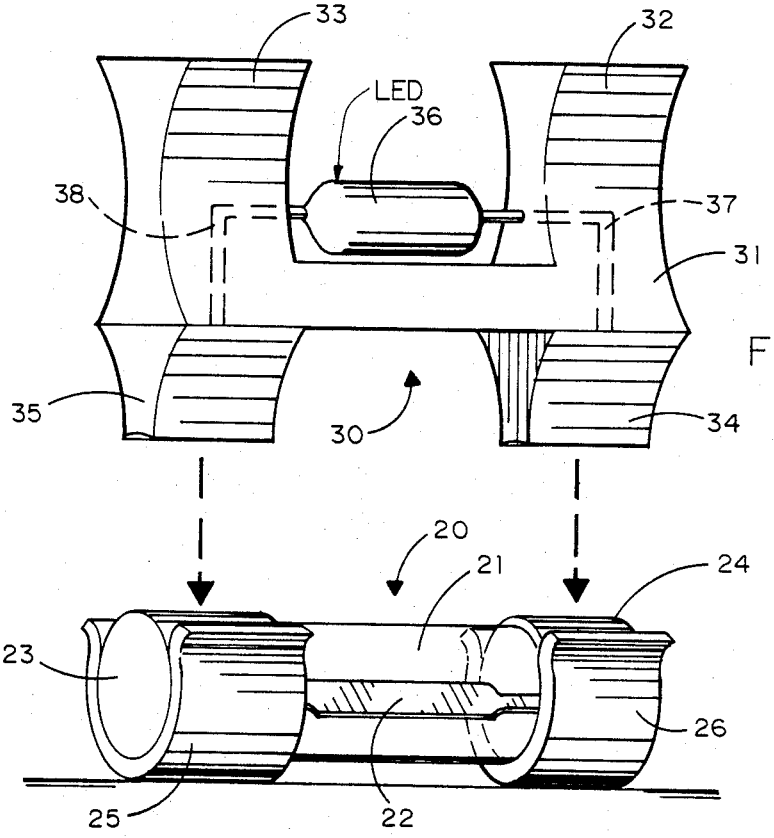
FIG. 2 is a schematic perspective indicating the general principle of this invention and how it can be adapted to a wide variety of circumstances.

FIG. 2 shows a fuse generally 20 having its case 21, ends 23 and 24, and fuse element 22 in a customary holder comprising clip elements 25 and 26. Above the fuse 20 is a light emitting diode carrier 30 comprising a case 31 having two handle portions 32 and 33 with electrical current conducting ends 38 and 37 with light emitting diode 36 connected between them. The electrical conducting elements 37 and 38 will be connected to electrical conducting elements 34 and 35 such that it may be used as a test instrument by pressing against the ends of the fuse, or, by modification, it could be permanently mounted upon the fuse or adjacent to it.

Figure 3:
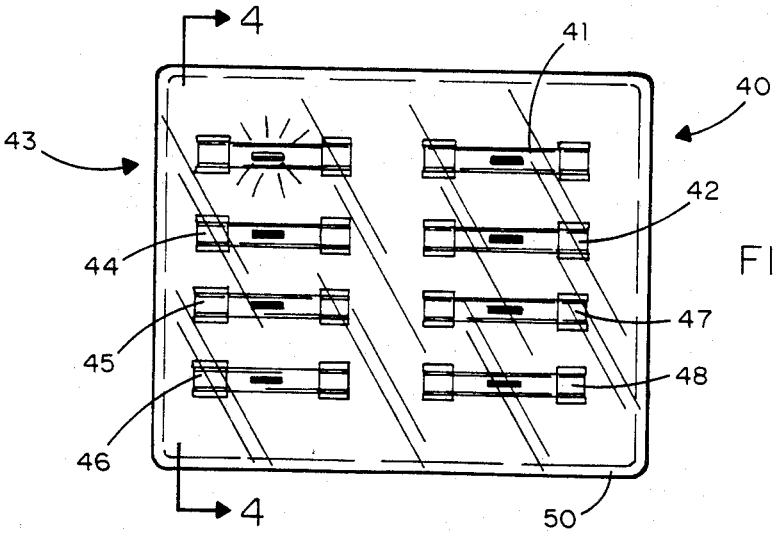
FIG. 3 is a plan schematic view of a number of fuses with diodes, one of which is emitting light to indicate failure.

FIG. 3 illustrates a bank of fuses such as might be found in an automobile with a transparent cover. The bank of fuses generally 40 comprises individual fuses 41, 42, 43, 44, 45, 46, 47, and 48. The fuse 43 has failed and the light emitting diode carried with it (in the manner as illustrated in FIG. 1) is lighted. Thus, it is very simple to determine which fuse has failed.

Figure 4:
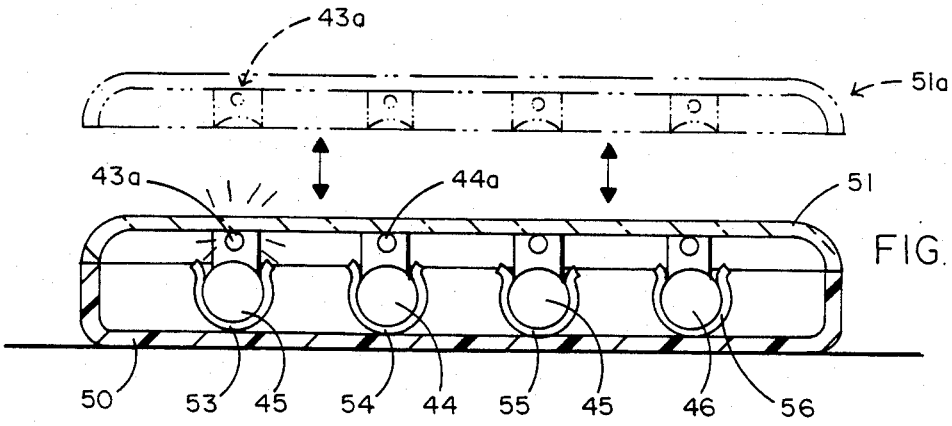
FIG. 4 is a section on 4—4 of FIG. 3, with a phantom illustration of the removal of the cover of the fuse box.

FIG. 4 merely illustrates the view which would be seen on the section 4—4 of FIG. 3 and shows in phantom how the removable cover 51 can be removed to the position 51*a* or any other position. In this case, the light emitting diode 43*a* associated with fuse 43 and the light emitting diode 44*a* associated with fuse 44 are shown. It is apparent that the fuse 43 has failed and the diode 43*a* is showing. The construction of the fuse box would include the lower portion 50 with appropriate clip elements 53, 54, 55, and 56 to hold the ends of fuses and from there to be connected to the appropriate electrical circuit.

Figure 5:
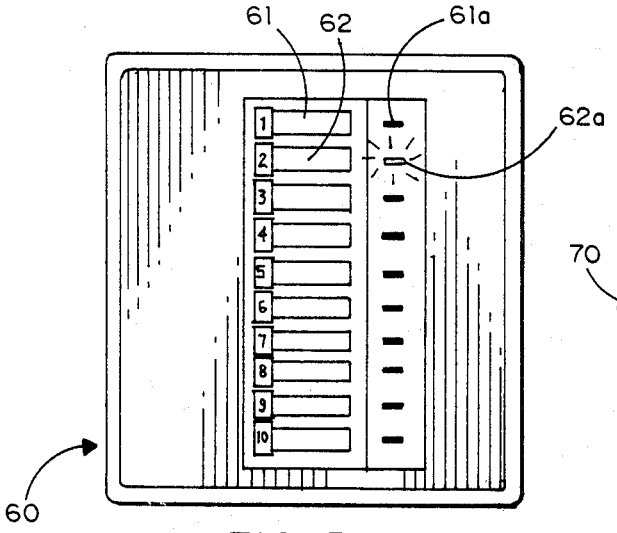
FIG. 5 is another illustration of a schematic plan view of either a fuse box or a circuit breaker with diodes permanently mounted to identify failed fuses.
Figure 5A:
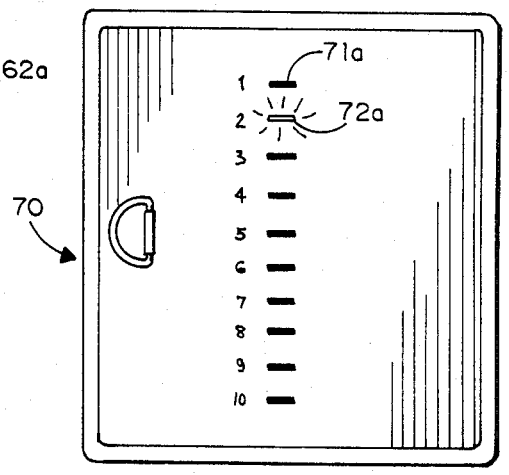
FIG. 5*a* is an alternate embodiment of FIG. 5 wherein the fuses are not visible and the diodes are affixed to a cover for a fuse or circuit box.

FIG. 5 illustrates a fuse box or circuit breaker such as might be found in a building. The fuses or circuit breakers 61 and 62, etc., each has adjacent and wired in parallel (wiring not shown) an appropriate light emitting diode 61*a* and 62*a*, etc. In this case the element 62*a* is shown lighted. Normally in this type fuse box a removable cover would not be transparent and would have to be removed to determine which fuse has failed. For that reason the illustration of FIG. 5*a* can also be used wherein the light emitting diodes can be mounted on the exterior of a fuse box or circuit breaker cover which would otherwise have nothing visible. In this case the light emitting diode 72*a*, being activated, would indicate that particular circuit was the problem circuit as opposed to 71*a* or the other circuits.

Figure 6:
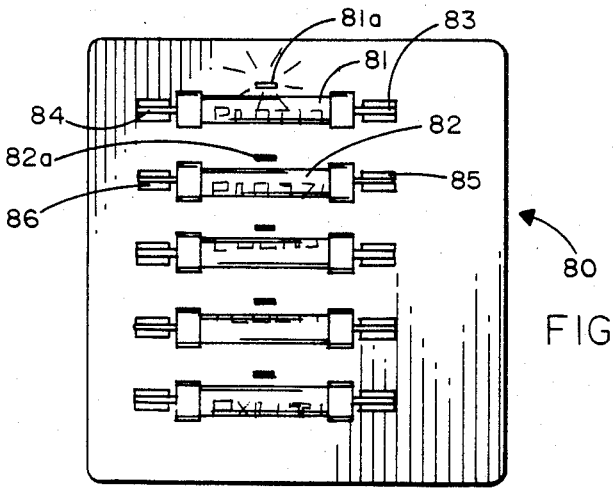
FIG. 6 illustrates the same principle with a different type of fuse.

FIG. 6 merely illustrates a different type fuse such as the type which has knife-like elements extending from the end in order to be contacted with the circuits to which they are assigned. In this case, for examp1e, the fuse 81 will be mounted as indicated at 83 and 84 and the fuse 82 will be mounted as indicated at 85 and 86. The light emitting diode 81*a* is emitting light, thus indicating a problem with the fuse or circuit 81 while the light emitting diode 82*a* is not lighted, indicating that that circuit is not a trouble circuit.

Figure 7:
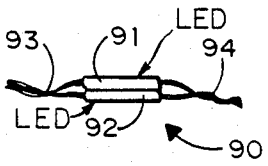
FIG. 7 illustrates a preferred way of practicing this invention with two diodes connected together in reverse polarity to one another.

Since light emitting diodes permit the passage of current in one direction only, it is desirable in practicing this method of fuse failure detection that two diodes 91 and 92, as illustrated in FIG. 7, be connected at their ends with their polarity reversed. For example, diode 92 might have its positive end to the left in the illustration and diode 91 would have its positive end to the right. Thus, when their leads are connected together as at 93 and 94, one of the diodes will light when the fuse has failed regardless of how the item is inserted into the appropriate circuit in connection with the appropriate fuse. Thus, while only a single diode has been shown in FIG. 1, it is to be understood that in each of the illustrations, such as FIG. 1, there could be this sandwich type construction of a double diode generally 90 in FIG. 7.

Any other device which will give a similar visual indication such as given by the light emitting diode could be used to practice this invention in lieu of a light emitting diode.

While the embodiment of this invention shown and described is fully capable of achieving the objects and advantages desired, it is to be understood that this embodiment is for purposes of illustration only and not for purposes of limitation.

I claim:

1. An automobile fuse bank holder comprising in combination a base in the form of a box open on its top side, said base containing a plurality of clip type fuse holders wherein each fuse holder comprises two end clips suitable to clip upon the ends of an elongated automotive type fuse; a cover means detachably mounted upon said base, wherein said cover means has a plurality of light emitting diode contact means so positioned therein that in pairs said light emitting diode contact means will contact, in cooperative pairs, the ends of fuses inserted within said pairs of clip means when the same are holding fuses; light emitting diode means inserted in electrical contact configuration between the pairs of light emitting diode contact means; and viewing means associated with each light emitting diode means in said cover means in such manner that each light emitting diode means is visible through said cover.

* * * * *